United States Patent [19]

Thompson et al.

[11] 4,131,551

[45] Dec. 26, 1978

[54] RAILWAY LUBRICATING OIL

[75] Inventors: Jerry L. Thompson, Wheaton, Ill.; Sigmund S. Deluga, Munster; James W. Harnach, Chesterton, both of Ind.; Eliahu Shamah, Naperville, Ill.

[73] Assignee: Standard Oil Company, Chicago, Ill.

[21] Appl. No.: 824,263

[22] Filed: Aug. 15, 1977

[51] Int. Cl.[2] ..... C10M 1/40; C10M 3/34; C10M 5/22; C10M 7/38

[52] U.S. Cl. ..... 252/33; 252/42.7; 252/389 R; 252/400 R

[58] Field of Search ..... 252/33, 42.7, 389 R, 252/400 R

[56] References Cited

U.S. PATENT DOCUMENTS

| | | | |
|---|---|---|---|
| 3,562,159 | 2/1971 | Mastin | 252/33 |
| 3,649,659 | 3/1972 | Otto et al. | 252/33 |
| 3,878,115 | 4/1975 | Gouillard et al. | 252/33.4 |
| 3,897,350 | 7/1975 | Heiba et al. | 252/33.4 |
| 4,010,106 | 3/1977 | Rothert | 252/32.7 E |
| 4,010,107 | 3/1977 | Rothert | 252/42.7 |

*Primary Examiner*—Irving Vaughn

*Attorney, Agent, or Firm*—Mark J. DiPietro; Arthur G. Gilkes; William T. McClain

[57] ABSTRACT

An improved lubricant composition comprises (A) a lubricant mineral oil base, (B) a Mannich condensation reaction product comprising the reaction product of an alkyl phenol, a polyamine and formaldehyde, (C) an alkaline earth metal salt of a Mannich condensation reaction product comprising the reaction product of alkyl phenol, formaldehyde and a polyamine, (D) an alkylbenzene alkaline earth metal sulfonate of low total base number, and (E) the alkaline earth metal salts of a bis-alkylphenol sulfide, (F) chlorinated paraffin, and (G) dimethyl siloxane polymer.

14 Claims, No Drawings

RAILWAY LUBRICATING OIL

BACKGROUND

1. Field of Invention

This invention relates to lubricating oil compositions. More particularly, this invention relates to lubricating oils of high dispersancy-detergency and high alkalinity reserve for use as crankcase lubricant in marine and heavy duty diesel, such as railway diesel engines.

2. Description of the Prior Art

Heavy duty diesel engines require crankcase lubricant oils which are stabilized against oxidation, are non-corrosive to bearing materials including silver, and suspend combustion products which would lead to the formation of deposits in engines and formation of sludge and varnish on piston, cylinders, cylinder liners, and undercrown cavities. The diesel crankcase lubricant should prevent carbon deposition especially in the top ring piston groove. High alkalinity is required to neutralize acids formed during fuel combustion, and to reduce the frequency of oil changes. In addition, the crankcase lubricating oil for heavy duty diesel engines must be so formulated that silver, copper, and lead parts in the engine are not attacked either by the additives in the oil or by the dispersed neutralized decomposition products produced during extended engine operation. The present invention is directed to an new, unique combination of lubricant oil additives in a suitable base oil for heavy duty diesel engine crankcase lubrication. The diesel engine crankcase lubricant composition of this invention, when field tested in modern, high-speed, railway diesel freight engines, has demonstrated the ability to maintain a clean engine and provide increased alkalinity reserve in the used crankcase oil, while at the same time protecting lead, copper, and silver-surfaced parts in the engine. Compatibility of this oil with other current railway oils has been shown in bench and engine tests. Formulations of lubricating oil exist which give adequate protection to heavy duty diesel engines. A novel formulation of a lubricating oil has been discovered which gives superior dispersancy-detergency, and superior alkalinity reserve and protection of lead and silver parts in raileay diesel engines.

Thus, it is an object of the invention to produce a novel, improved lubricating oil. Another object of the invention is to produce a novel lubricating oil with increased alkalinity reserve. Sitll another object of the invention is to produce a novel lubricating oil which provides superior protection to lead, copper, and silver parts in railway engines. A further object of the invention is to produce a new lubricant oil which has a lower ash content than other railway oil formulations with equivalent alkalinity. Other objects of the invention are to produce an extended life railway diesel engine lubricant oil which controls engine deposits, provides protection against corrosive wear, especially with high-sulfur diesel fuels and maintains an adequate alkalinity reserve under severe operating conditions.

SUMMARY OF THE INVENTION

The compositions disclosed are improved lubricant compositions comprising (A) a lubricant mineral base oil, (B) a Mannich condensation reaction product comprising the reaction product of an alkyl phenol, a polyamine and formaldehyde, (C) an alkaline earth metal salt of a Mannich condensation reaction product comprising the reaction product of an alkyl phenol, formaldehyde and a polyamine, (D) an alkyl benzene sulfonate of an alkaline earth metal of low total base number, (E) an alkaline earth metal salt of bisalkylphenol sulfide, (F) a chlorinated paraffin, and (G) a small amount of a poly dimethyl siloxane. The improved lubricant composition may comprise from about 90 to about 83 weight percent of the lubricant mineral base oil, from about 1.9 to about 3.4 weight percent of the alkylphenol Mannich condensation reaction product, from about 2.0 to about 6.0 weight percent of the alkaline earth metal salt of the alkyl benzene sulfonic acid, from about 2.5 to about 7.0 weight percent of an overbased alkaline earth salt of the bisalkylphenol sulfide, from about 1.0 to about 3.0 weight percent of the alkaline earth metal salt of Mannich condensation reaction product comprising the alkylphenol, the formaldehyde, polyamine reaction product, about 0.15 to about 2.0 weight percent of the chlorinated paraffin and about 1 to about 25 parts per million, based on the lube oil composition of a polydimethyl siloxane. The composition of the lubricant oil may contain a mineral base oil. The composition may also contain a blend of lubricant oils having viscosities at 100° F. in the range of about 300 to about 1300 Saybolt Universal seconds such that the final viscosity at 100° F. of the base oil is in the range of about 800 to about 1200 Saybolt Universal seconds. The composition of the lubricant oil may contain the alkyl phenol Mannich condensation product wherein the alkyl moiety is derived from a polyalkene selected from the group consisting of polyethene, polybutene and polypropene, the molecular weight of which is in the range of about 500 to about 30,000. The composition of the lubricant oil may contain an alkyl phenol Mannich condensation reaction product wherein the alkyl moiety has from 6 to about 12 carbon atoms. The composition of the lubricant oil may contain an alkyl benzene sulfonic acid where the alkyl moiety of the alkyl benzene sulfonic acid is selected from the group consisting of groups derived from polyethene, polybutene and polypropene whose molecular weights are in thee range of about 400 to about 900. The composition may also contain a calcium salt of an alkyl bis-phenol sulfide wherein the alkyl moiety has from about 6 to about 12 carbon atoms. The composition of the lubricant oil may contain a chlorinated paraffin which is from about 30 to about 70 weight percent chlorine and a molecular weight of from about 350 to 1100. A composition of the lubricating oil may have a dimethyl siloxane polymer having a viscosity at about 77° F. from about 300 to about 30,000 centistokes. The improved lubricant composition may comprise (A) a lubricant base oil stock; (B) about 1.9 to about 3.4 weight percent of the Mannich condensation product which comprises the reaction product of polybutyl phenol wherein the polybutyl moiety is from about 500 to about 30,000 molecular weight and formaldehyde and tetraethylene pentamine; (C) from about 1.0 to about 3.0 weight percent of the calcium salt of Mannich condensation product which comprises the reaction product of a nonyl phenol, formaldehyde and ethylene diamine; (D) about 1.5 to about 5.0 weight percent low base number overbased alkaline earth metal salt of the polypropyl benzene sulfonic acid wherein the polypropyl moiety has a molecular weight from about 400 to about 600; (E) about 2.5 to about 4.8 weight percent of the overbased sulfurized calcium bis-alkylphenol sulfide; (F) from about 0.15 to about 2.0 weight percent of a chlorinated paraffin which contains 40 to 45 weight percent chlorine; (G) from about 2.5 to about 25 parts per million, based on a lubricant oil, of a dimethyl siloxane polymer whose viscosity at 77° F. is from about 10,000 to about 13,000 centistokes.

The improved lubricant composition may also comprise (A) a lubricant oil base stock, (B) about 3.0 weight percent of the Mannich condensation product which comprises the reaction product of a polybutyl phenol, the polybutyl moiety is about 500 to about 30,000 molecular weight, formaldehyde and tetraethylenepentamine; (C) about 2.0 weight percent of the low base number alkaline earth metal salt of the polypropyl benzene sulfonic acid, the polypropyl moiety having a molecular weight from about 400 to about 900; (D) about 4.2 weight percent of the overbased calcium bisalkylphenol sulfide the alkyl group having about 6 to about 12 carbon atoms; (E) about 1.6 weight percent of the calcium salt of a Mannich condensation product which comprises the reaction product of a nonyl phenol, formaldehyde and ethylene diamine; (F) about 0.2 weight percent of a chlorinated paraffin which contains about 43 weight percent chlorine whose molecular weight is from 300 to 1000; and (G) from about 2.5 to about 25 parts per million, based on the oil, of a dimethyl siloxane polymer whose viscosity at 77° F. is from about 10,000 to 12,000 centistockes.

DETAILED DESCRIPTION

The improved lubricating oil can be produced by suspending or dissolving in the base oil the various additives. The suitable base lubricant mineral oil is selected to conform to viscosity requirements. Either a single base oil or blends of different viscosity base oils may be used as the base for the additive lubricant oil. The components may be blended in any order and in any combination. The first component of the improved lubricant composition is the Mannich condensation reaction product which comprises the reaction product of a polyalkyl phenol, a polyamine and formaldehyde. The alkyl phenol is commonly a high molecular weight, alkyl-substituted hydroxy aromatic compound such as polypropyl phenol, polybutyl phenol or other alkyl phenols. These alkyl phenols may be obtained by the alkylation of phenol in the presence of an alkylating catalyst such as $BF_3$—HF, $BF_3$ or $AlCl_3$ with high molecular weight polypropylene, polybutylene or other polyalkene compounds to give alkyl substituents on the benzene ring of the phenol having a number average molecular weight of 600 to 100,000. These alkyl-substituted hydroxy aromatic compounds may be derived from polypropenes, polybutenes and other polymers of monoolefins, principally 1-butene, 2-butene, isobutene and propene. Also, monomers may be copolymerized with propene or butene and other chlorinated, brominated or other derivatives of monoalkene compounds. Mannich condensation reaction products disclosed herein may also contain boron in many forms. The Mannich products may also contain fatty acids. The boron and fatty acid components are believed to promote ease of production of the additives. The boron and fatty acids also increase the detergency, dispersancy, and deposit preventing properties of the Mannich additives. Fatty acids such as oleic, linoleic, stearic, and other $C_{16}$ to $C_{24}$ acids are commonly useable. Boron is generally introduced in the form of superborate salts, borate salts, and boric acid.

Preferably, the configuration of the alkyl-substituted hydroxy aromatic compound is that of para-alkyl phenol. However, other alkyl phenols are relatively reactive and thus useful in the Mannich condensation product.

Representative amine reactants are alkane polyamine, principally, polyethylene polyamines. The polyamines which may be used are ethylamine, diethyl amine, dimethyl amine or propyl amine and diethylol amine; ethylene diamine, diethylene triamine, triethylene tetraamine, triethylene pentamine, pentaethylene hexamine, hexethylene heptamine and mixtures of the amines, including polypropylenes polyamines, having nitrogen content corresponding to the alkylene polyamines of which the formula $NH_2[(CH_2)_xNH—]_y$ is representative. X is a number from 2 through 4, and y is a number from 1 through 6.

Representative aldehydes for use in the preparation of the high molecular weight products of this invention include aliphatic aldehydes such as formaldehyde, including paraformaldehyde and formalin, acetaldehyde and aldol (betahydroxybutyraldehyde). Preferably a formaldehyde or a formaldehyde-yielding reactant is used.

Another component of the formulation of the improved lubricant oil are low or high base number alkylbenzene sulfonates. These overbased alkyl sulfonic acids are produced from alkylated benzene sulfonic acids. These alkylated benzene sulfonic acids are generally produced by sulfonating benzene alkylates. The broad class of benzene alkylates include such compounds as polypropyl benzene, poly 1-butylbenzene, poly isobutylbenzene, poly 2-butylbenzene, polyethylene benzene and copolymers of propyl and 1-butyl benzene and other various copolymers of ethene, propene and butene isomers. The preferred alkyl benzenes are polypropyl, polybutyl and copolymer propyl 1-butyl benzenes. Especially preferred are polypropyl benzenes wherein the alkyl moiety has a number average molecular weight of from about 400 to about 900. The alkaline metal oxide which is used to overbase the alkyl sulfonic acids may be chosen from a group consisting of barium oxide, calcium oxide, magnesium oxide or other Group I and Group II metal bases. Preferably, the overbased sulfonic acids are produced from calcium oxide. The alkyl benzenes are commonly sufonated with fuming sulfuric acid or oleum, in standard industrial sulfonation procedures. The sulfonate is overbased when the sulfonate contains more base than is needed to neutralize the sulfonic acid. Degrees of overbasing are measured in the form of Total Base Number (TBN) by ASTM Test 664. Total base number is equivalent to the milligrams of KOH equivalent to the amount of base in the composition which exceeds the amount needed to neutralize the sulfonic acids. TBN's of 1 to 400 are common.

Another component of the invention is the alkaline earth salt of an alkyl phenol, formaldehyde, polyamine Mannich condensation reaction product. Phenols which have utility in this application are alkylated phenols such as methyl, ethyl, propyl, butyl, pentyl, hexyl, heptyl, octyl, nonyl decyl, undecyl, dodecyl phenol and the like. Also useful are alkylated phenols such as polyalkyl phenols formed from polyalkenes and phenol. Formaldehyde may be in the form of paraformaldehyde, formalin, or other well known formaldehyde generating reactants. Polyamines such as ethylene diamine, diethylene triamine, and tetraethylene pentamine find utility in this product. The Mannich condensation reaction product is overbased using an alkaline earth metal such as calcium, barium or magnesium to total base numbers of from about 1 to 170. The metal may be in the form of oxides or hydroxides or carbonate.

The alkaline earth metal salt of a bis-alkyl phenol sulfide is used as an alkalinity agent and detergent. Alkylphenols such as dodecyl, undecyl, decyl, nonyl, octyl and other phenols which are alkylated by groups formed from polyalkenes commonly are used. The alkyl phenols react with free sulfur and an alkaline earth metal such as calcium or magnesium to form the alkaline earth metal salt of a bis-alkyl phenol sulfide. Total base numbers from about 1 to about 250 may be attained.

The chlorinated paraffin used in the composition is used to insure composition compatibility with silver parts of engines. It is chosen from a family of compounds which include liquid and solid, chlorinated paraffin compounds. They are non-flammable, of low toxicity, and are used in extreme pressure duty lubricants. The preferred chlorinated paraffin has a viscosity at 25° C. of greater than 25 poise at 100° F., or 3,000 Saybolt Universal seconds and at 210° F. greater than 150 Saybolt Universal seconds. Its specific gravity at 25° C. is greater than 1.10 and it contains approximately from about 40 to about 70 weight percent chlorine. The molecular weight of this compound commonly ranges from about 300 to 1000 or 350 to 1100. A small amount of a silicone anti-foam agent commonly used in the art is also incorporated in the formulation. In general terms this is a polydimethyl siloxane. The typical properties of the preferred polymer, at 77° F., are viscosity in the range of about 10 to 100,000 centistokes, pour point is about 40° F. to 60° F., specific gravity is about 0.900 to about 0.995 and each of these blends of silicone fluids contains a broad range of molecular weights.

EMBODIMENT OF THE INVENTION

The following examples are illustrative of the preferred embodiments of the present invention.

EXAMPLE 1

Preparation of (B) Mannich condensation product

A stirred reactor is charged with 0.4 moles of nonylphenol over a period of 7 hours, about 1 mole of boron trifluoride, $BF_3$, is blown into the phenol while maintaining the temperature below 175° F. The resultant $BF_3$ complex has a boron content of about 1 percent. 100 gms. of the $BF_3$-nonyl phenol complex is added to 1100 gms. of polybutene having an average molecular weight of about 900, diluted with solvent-extracted 5W oil, with stirring, at about 100° to 125° F. After stirring the reaction mass at 100° to 125° F. for about an hour, the reaction mass is neutralized. The reaction mass is then heated to about 500° F. while excess volatiles are stripped therefrom with inert gas. The polybutyl phenol amine condensation reaction product is prepared by charging the stirred reactor with 1200 gms. of the polybutyl phenol produced in the preceding step, together with 775 gms. of tetraethylene pentamine and the temperature is adjusted to 80° F. or less. Then there is added 710 gms. formaldehyde. After th formaldehyde addition, the reaction mixture is rapidly heated to about 320° F. while blowing with an inert gas to remove and other volatiles. The stripped reaction mixture is then filtered and the filtrate is diluted with solvent and ready for use.

EXAMPLE II

Preparation of (C) calcium salt of Mannich reaction product 8.0 moles of nonyl phenol in a diluent oil were added to a flask under a nitrogen blanket. 4.0 moles of ethylene diamine were added to the flask. 7.0 moles of formaldehyde were added at a rate to keep the flask below 300° F. The mixture was heated to 300° F. for one hour. The mixture was cooled. Antifoam agents and diluent oil was added. 3.0 moles of calcium hydroxide in 400 milliliters of diluent oil were added to the mixture. The reaction mixture was heated to 190° F. for one hour, then heated to 300° F. to remove water which was blown with nitrogen. The mixture was cooled and filtered to a clear product.

EXAMPLE III

Preparation of Sulfonate (D)

1.070 grams of benzene is charged into a reaction vessel and heated with steam. 17.4 grams of aluminum chloride is slowly added to the benzene and the mixture is stirred until a complex agent reaction mixture is completed, approximately a half hour. Into this mixture is mixed 870 grams of a polypropylene which has a molecular weight of from about 400 to about 600. The polypropylene is added at a rate so that the addition is complete in about 20 minutes. At the end of the addition, the reaction is continued for another 20 minutes. At the end of this time the mixture is heated to approximately 250° F. and is blown with nitrogen or steam to remove benzene, unreacted polymer, and light alkylates. The heavy alkylate is recovered. Approximately 720 grams of polymer alkylate is produced. The sulfonation of the alkylate is done by mixing a jacketed vessel the alkylate and approximately an equal amount of 22 percent oleum over a time period of about 1.5 hours. During this mixing step the temperature of the mixture is not allowed to exceed 95° F. Upon completion of the mixing, the mixture is allowed to react for approximately 1 hour at a temperature not greater than 130° F. At the end of this time the mixture is diluted with 250 grams of water to form a concentration of sulfuric acid in the aqueous layer of less than 85 percent. The mixture is allowed to settle and separate into a lower sulfuric acid layer and an upper sulfonic acid product. The separation is substantially complete in approximately 20 minutes. To prepare the calcium overbased sulfonate, in a reaction vessel is placed 1.38 of mols of sulfonic acid, 300 ml. of xylene, 929 mols of calcium oxide and 24.7 mols of methanol. Into this mixture at 80° F. is bubbled carbon dioxide and ammonia. The carbonation is continued for approximately 1 hour. At the end of this time, the temperature of the reaction vessel is increased to 250° F. and the reaction mixture is blown with an inert gas to remove the xylene, the methanol and unreacted carbon dioxide and ammonia. The mixture is filtered and the overbased calcium sulfonate is recovered. Overbasing technology is well known and variation in base number are readily achieved.

EXAMPLE IV

Preparation of Calcium Alkyl Phenol Sulfide (E)

To a 5 liter flask fitted with a stirrer and Dean Stark trap was added the following:

| Component | Grams | Moles |
|---|---|---|
| Nonylphenol | 157 | 0.71 |
| Dodecylphenol | 784 | 2.99 |
| SX-5W Oil | 886 | (239 g/mole phenols) |
| Calcium Hydroxide | 184 | 2.49 |
| Sulfur | 129 | 4.03 |

The mass was heated to 360° F. and held there for 2 hours. Volatiles are removed by heating to 460° F. while blowing with a small stream of nitrogen. Filter-aid was added and the product was isolated by filtration. The Base number was 123.

TABLE I

Improved Test Lubricant Formulations

| | Per Cent by Weight | | | |
|---|---|---|---|---|
| | 1 | 2 | 3 | 4 |
| Mannich (B) Additive | 1.87 | 3.0 | 2.7 | 3.5 |
| Ca Mannich (C) Salt | 1.1 | 1.6 | 1.6 | 1.6 |
| Calcium (D) Sulfonate | 5.0 | 2.0 | 2.0 | 2.0 |
| Bis-Phenol (E) Sulfide | 2.7 | 4.2 | 4.1 | 2.0 |
| Chlorinated Paraffin (F) | 0.13 | 0.2 | 0.13 | 0.20 |
| Siloxane Polymer (G) | 5 ppm | 5 ppm | 5 ppm | 5 ppm |
| Base Oil (A) | Balance | | | |

TABLE II

120 Hr. Caterpillar 1-G Test Results

| | Test Oils | | | |
|---|---|---|---|---|
| | 1 | 2 | 3 | 4 |
| Top Grove Fill Per Cent | 37 | 6 | 46 | 19 |
| CRC Demerits: | | | | |
| Weighted Carbon Demerits | 91 | 18 | 72 | 89 |
| Weighted Lacquer Demerits | 46 | 90 | 109 | 135 |
| Weighted Total Demerits | 137 | 108 | 151 | 224 |

TABLE III

EMD 2-567 Engine Tests

| | Test Oils | | | |
|---|---|---|---|---|
| | 1 | 2 | 3 | 4 |
| Silver Corrosion Demerits: | | | | |
| Right Bearing No. 1 | 28 | 22 | 29 | 42 |
| Left Bearing No. 2 | 46 | 28 | 34 | 46 |
| Average | 37 | 25 | 32 | 44 |

TABLE IV

Alkalinity Retention

| | ASTM Test | Alkalinity After Test 1 | Alkalinity After Test 2 | Per Cent Increase in Alkalinity Retention |
|---|---|---|---|---|
| CAT 1-G | D-2896 | 4.8 | 8.3 | 61 |
| | D-664 | 2.3 | 3.7 | 73 |
| EMD 2-567 | D-664 | 1.1 | 2.1 | 40 |

TABLE V

Example Inspection of Test Oil 2

| | |
|---|---|
| Gravity, °API | 24.1 |
| Viscosity, SUS at 100° F | 998 |
| Viscosity, SUS at 210° F | 79 |
| Viscosity Index | 72 |
| Flash Pt, ° F | 470 |
| Pour Pt, ° F | +5 |
| TBN, D-664 | 8.4 |
| TAN, D-664 | 0.8 |
| TNB, D-2896 | 10.0 |
| Chlorine, ppm | 850 |
| Calcium, wt. % | .29 |
| Sulfur, wt. % | .32 |
| Nitrogen, wt. % | 0.07 |
| Sulfated Ash, wt. % | .92 |
| Zinc, ppm | 5 |
| Boron, ppm | 5 |
| Magnesium, ppm | 10 |
| Potassium, ppm | 1 |
| Silver Disc Four Ball at 350° F (scar dia., mm) | 1.52 |
| at 500° F (scar dia., mm) | 1.64 |

TABLE VI

RAILWAY FIELD TEST OF TEST OIL 2
SUMMARY OF NINE MONTH WEAR INSPECTIONS

| Locomotive Number | 1 | | | | 2 | | | | 3*** | | | | 4 | | | | Average Change |
|---|---|---|---|---|---|---|---|---|---|---|---|---|---|---|---|---|---|
| Test Miles at 9 Mo. Insp. | 62700 | | | | 39600 | | | | 43500 | | | | 68400 | | | | |
| Cylinder Number | 1 | 8 | 9 | 16 | 1 | 8 | 9 | 16 | 1 | 8 | 9 | 16 | 1 | 8 | 9 | 16 | (in × $10^3$) |
| Side Clearance, in × $10^3$ | | | | | | | | | | | | | | | | | |
| Top Ring, Initial | 14 | 11 | 11 | 9 | 11 | 12 | 9 | 5 | 9 | 7 | 9 | 8 | 8 | 8 | 8 | 7 | |
| 4 Months | | | | | 11 | 11 | 9 | 9 | | | | | 10 | 10 | 9 | 7 | |
| Change - 4 Months | | | | | 0 | −1 | 0 | 4 | | | | | 2 | 2 | 1 | 0 | 1.0 |
| 9 Months | 17 | 13 | 18 | 12 | 13 | 11 | 12 | 12 | 10 | 9 | 10 | 9 | 11 | 10 | 9 | 8 | |
| Change - 9 Months | 3 | 2 | 7 | 3 | 2 | −1 | 3 | 7 | 1 | 2 | 1 | 1 | 3 | 2 | 1 | 1 | 2.9 |
| Ring Face Condition* | | | | | | | | | | | | | | | | | |
| Top Ring, Initial | 2A | 2A | 2A | 2A | Not Rated | | | | | | | | 2-2A | 2 | 2 | 2 | |
| 4 Months | Not Inspected | | | | 2-2A | 2A | 2A | 2 | — | — | — | — | 2A | 2A | 2 | 2 | |
| 9 Months | 2A | 2A | 2A | 2A | 2-2A | 2A | 2A | 2 | 2A | 2-2A | 2A | 2A | 2-2A | 2A | 2-2A | 2A | |
| No. 2 Ring, Initial | 2A | 2A | 2A | 1 | Not Rated | | | | — | — | — | — | 2 | 2 | 2 | 2 | |
| 4 Months | | | | | | | | | 2 | 2 | 2 | 2 | 2 | 2 | 2 | 2 | |
| 9 Months | 2-2A | 2 | 2 | 2 | 2 | 2 | 2 | | | | | | 2-2A | 2-2A | 2 | 2 | |
| *Ring Face Rating Scale | | | | | | | | | | | | | | | | | |
| 1 - Light Grooves Visible | } Early Wear Stages. | | | | | | | | | | | | | | | | |
| 2 - Faint Grooves Visible | | | | | | | | | | | | | | | | | |
| 2A - Ring Face Smooth - Major Portion of Life Remains. | | | | | | | | | | | | | | | | | |
| Supplemental Observations | | | | | | | | | | | | | | | | | |
| Ring Gap** - No. 1 Ring - (9 Months) | .150 | — | — | | — | — | — | | — | — | — | — | — | .100 | — | — | |

**When gap visible through port.
***3 mo. only

Test oil 2 shows, in these data tables, an unobviously better performance. In each test the performance of test oil 2 is significantly better than the comparison oils. The composition of test oil 2 has been successfully tested in diesel engines now operating in commercial service, and in admixture with other railway oils.

The Caterpillar 1-G and EMD 2-567 are well known tests in which diesel engines are run under various operating conditions of temperature, speed and load to test lubricant performance. The Caterpillar 1-G and EMD 2-567 are the standard tests for the examination of railway diesel lubricants. ASTM D-2896 and D-664 are potentiometric titration methods for determination of basicity in petroleum oils. D-2896 uses perchloric acid as a titrant and D-664 uses hydrochloric acid or potassium hydroxide.

We claim:

1. An improved lubricant composition comprising:
(a) from about 90 to about 83 weight percent of a lubricant mineral base oil,
(b) from about 1.9 to about 3.4 weight percent of an alkyl phenol Mannich condensation product comprising the reaction product with formaldehyde and a polyamine,
(c) from about 1.0 to about 3.0 weight percent of alkaline earth metal salt of the Mannich condensation reaction product comprising an alkyl phenol Mannich condensation product with formaldehyde and a polyamine,
(d) 2.0 to about 6.0 weight percent of an overbased alkaline earth metal alkyl benzene sulfonate having a TBN of at least 1,
(e) from about 2.5 to about 7.0 weight percent of an overbased alkaline earth salt of the bis-alkyl phenol sulfide,
(f) about 0.15 to 2.0 weight percent of a chlorinated paraffin, and
(g) about 1 to about 25 parts per million based on the lube oil composition of a polydimethyl siloxane.

2. The composition of claim 1 wherein the lubricant mineral base oil is a single base oil with a viscosity at 100° F. of about 800 to about 1,200 Saybolt Universal seconds.

3. The composition of claim 1 wherein the lubricant mineral base oil is a blend of lubricant oils having a viscosity at 100° F. in the range of about 300 to about 1,300 Saybolt Universal seconds such that the final viscosity of 100° F. of the base oil is in the range of about 800 to about 1,200 Saybolt Universal seconds.

4. The composition of claim 1 wherein the alkyl moiety of the alkyl phenol in (b) is selected from the group consisting of a polyethene, a polybutene or a polypropene the molecular weight of which is in the range of from about 500 to about 30,000.

5. The composition of claim 1 wherein the alkyl moiety of the alkyl phenol in (c) has from about 6 to about 12 carbon atoms.

6. The composition of claim 1 wherein the polyalkyl moiety of the alkyl sulfonic acid in (d) is selected from the group consisting of polyethene, polybutene, and polypropene, whose molecular weight is in the range of from about 400 to about 900.

7. The composition of claim 1 wherein the alkyl moiety of the alkyl phenol in (e) has from about 6 to about 12 carbon atoms.

8. The composition of claim 1 wherein the composition of the chlorinated paraffins has from about 30 percent to about 70 percent chlorine, and a molecular weight which ranges from about 350 to about 1,100.

9. The composition of claim 1 wherein the dimethyl siloxane polymer has a viscosity at 77° F. of from about 300 to about 30,000 centistokes.

10. An improved lubricant composition comprising:
(a) a major portion of a lubricant oil base stock,
(b) about 1.9 to about 3.4 weight percent of a Mannich condensation product comprising the reaction product of polybutyl phenol, the polybutyl moiety of which is about 500 to about 30,000 molecular weight, and formaldehyde and tetraethylene-pentamine,
(c) from about 1.0 to about 3.0 weight percent of a calcium salt of a Mannich condensation product comprising the reaction product of nonyl phenol, formaldehyde and ethylene diamine,
(d) about 1.5 to about 5.0 weight percent of an overbased alkaline earth polypropyl benzene sulfonate the polypropyl moiety having a molecular weight of from about 400 to about 900, having a TBN of at least 1,
(e) about 2.5 to about 4.8 weight percent of an overbased sulfurized calcium bis-alkyl phenol sulfide, the alkyl group having 6 to 12 carbon atoms,
(f) from about 0.15 to about 2.0 weight percent of a chlorinated paraffin containing from about 30 to about 70 weight percent chlorine, and
(g) from about 2.5 to about 25 parts per million, based on the oil, of a dimethyl siloxane polymer whose viscosity at 77° F. is from about 10,000 to about 30,000 centistokes.

11. An improved lubricant composition comprising;
(a) a major portion of a lubricant oil base stock,
(b) about 3.0 weight percent of the Mannich condensation product comprising the reaction product of a polybutyl phenol, the polybutyl moiety having about a molecular weight of about 500 to about 30,000, and formaldehyde and tetraethylenepentamine,
(c) about 2.0 weight percent of an overbased alkaline earth polypropyl benzene sulfonate, the polypropyl moiety having a molecular weight of about 400 to about 900, having a TBN of at least 1,
(d) about 4.2 weight percent of the overbased sulfurized calcium bis-alkylphenol sulfide, the alkyl group having 6 to 12 carbon atoms,
(e) about 1.6 weight percent of the calcium salt of a Mannich condensation product comprising the reaction product of nonyl phenol, formaldehyde and ethylene diamine,
(f) about 0.2 weight percent of a chlorinated paraffin which contains about 43 weight percent chlorine whose molecular weight is from about 3,000 to about 1,000, and
(g) about 2.5 to about 25 parts per million based on the oil of a dimethyl siloxane polymer whose viscosity at 77° F. is about 10,000 to about 13,000 centistokes.

12. The lubricant of claim 1 wherein the overbased alkaline earth alkyl benzene sulfonate is an overbased calcium alkyl benzene sulfonate.

13. The lubricant of claim 10 wherein the overbased alkaline earth polypropyl benzene sulfonate is an overbased calcium polypropyl benzene sulfonate.

14. The lubricant of claim 11 wherein the overbased alkaline earth polypropyl benzene sulfonate is an overbased calcium polypropyl benzene sulfonate.

* * * * *

CERTIFICATE OF CORRECTION

Patent No. 4,131,551 Dated December 26, 1978

Inventor(s) Jerry L. Thompson, Sigmund S. Deluga and James W. Harnach and Eliahu Shamah It is certified that error appears in the above-identified patent and that said Letters Patent are hereby corrected as shown below:

| Patent Col. | Patent Line | |
|---|---|---|
| 1 | 28 | "an new" should read -- a new -- |
| 1 | 44 | "raileay" should read -- railway -- |
| 2 | 40 | "thee range" should read -- the range -- |
| 4 | 9 | "hexethylene" should read -- hexaethylene -- |
| 4 | 59 | "nonyl decyl" should read -- nonyl, decyl -- |
| 5 | 63 | "After th" should read -- After the -- |
| 5 | 65 | "and" should read -- any -- |
| 6 | 21 | "1.070 grams" should read -- 1,070 grams -- |

UNITED STATES PATENT OFFICE

CERTIFICATE OF CORRECTION

Patent No. 4,131,551 Dated December 26, 1978

Inventor(s) Jerry L. Thompson, Sigmund S. Deluga, James W. Harnach and Eliahu Shamah It is certified that error appears in the above-identified patent and that said Letters Patent are hereby corrected as shown below:

6 37 * "mixing a" should read -- mixing in a --

6 62 "variation" should read -- variations --

Table II is split so as to be confusing--also "Weighted Total Demerits" of Test Oil 3 reads "151" should be 181.

Signed and Sealed this

Third Day of July 1979

[SEAL]

Attest:

Attesting Officer

LUTRELLE F. PARKER

Acting Commissioner of Patents and Trademarks